US007505727B2

(12) United States Patent
Jang et al.

(10) Patent No.: US 7,505,727 B2
(45) Date of Patent: Mar. 17, 2009

(54) FIXING ROLLER INCLUDING A PRESSING PIPE HAVING A CUT AWAY PORTION FOR AN IMAGE FORMING APPARATUS

(75) Inventors: Jae-hyeok Jang, Seoul (KR); Hwan-geum Kim, Seoul (KR); Gyu-seob Song, Daejeon (KR)

(73) Assignee: Samsung Electronics Co., Ltd., Suwon-si, Gyeonggi-do ( * ) Notice: Subject to any disclaimer, the term of this patent is extended or adjusted under 35 U.S.C. 154(b) by 345 days.

(21) Appl. No.: 11/385,846

(22) Filed: Mar. 22, 2006

(65) Prior Publication Data

US 2006/0291923 A1 Dec. 28, 2006

(30) Foreign Application Priority Data

Jun. 24, 2005 (KR) ..... 10-2005-0054806

(51) Int. Cl.
*G03G 15/20* (2006.01)

(52) U.S. Cl. ..... 399/333

(58) Field of Classification Search ..... 399/328, 399/330, 333; 219/216, 619
See application file for complete search history.

(56) References Cited

U.S. PATENT DOCUMENTS

| | | | | |
|---|---|---|---|---|
| 6,327,456 | B1 * | 12/2001 | Higaya | 399/333 |
| 6,907,219 | B2 * | 6/2005 | Kim et al. | 399/328 |
| 7,024,146 | B2 * | 4/2006 | Kim et al. | 399/330 |
| 7,026,578 | B2 * | 4/2006 | Mori et al. | 219/216 |

FOREIGN PATENT DOCUMENTS

| | | |
|---|---|---|
| JP | 11-194635 | 7/1999 |
| JP | 2001-235955 | 8/2001 |
| JP | 2001-282025 | 10/2001 |
| JP | 2004-226464 | 8/2004 |

* cited by examiner

*Primary Examiner*—William J Royer
(74) *Attorney, Agent, or Firm*—Roylance, Abrams, Berdo & Goodman, L.L.P.

(57) ABSTRACT

A fixing roller of an image forming apparatus includes a roller body having a pipe form. A coil assembly is mounted within the roller body and has an induction coil, and an inside and outside thereof are coated with insulators. A pressing pipe is mounted to the roller body to tightly bias the coil assembly toward an inner surface of the roller body. The pressing pipe has a cut away portion along a lengthwise direction to contract and expand in a circumferential direction.

19 Claims, 5 Drawing Sheets

FIXING ROLLER INCLUDING A PRESSING PIPE HAVING A CUT AWAY PORTION FOR AN IMAGE FORMING APPARATUS

CROSS-REFERENCE TO RELATED APPLICATIONS

This application claims the benefit under 35 U.S.C. § 119 (a) of Korean Patent Application No. 2005-54806 filed on Jun. 24, 2005, in the Korean Intellectual Property Office, the entire disclosure of which is hereby incorporated by reference.

BACKGROUND OF THE INVENTION

1. Field of the Invention

The present invention relates to a fixing roller of an image forming apparatus.

2. Description of the Related Art

Generally, an electrophotographic image forming apparatus scans an image carrying medium with a laser beam projected by a laser scan unit, thereby producing an electrostatic latent image on a surface of the image carrying medium. Developer, such as toner, is provided to the electrostatic latent image by a developing device and a toner image is visualized.

The visible image is transferred onto a printing paper that passes through the image carrying medium and a transferring roller. As the printing paper passes through a space between a fixing roller and a backup roller rotating in contact with each other, the visible image is fixed onto the printing paper by heat and pressure.

Recently, fixing rollers have adopted an inductive heating system. In the fixing roller applying the inductive heating system, an induction coil is disposed within a passive heating roller comprising a magnetic substance, and an insulator layer is provided between the induction coil and the passive heating roller. Because the passive heating roller is a rotatable part in this structure, the induction coil is preferably contacted as tightly as possible with the passive heating roller to enhance inductive heating efficiency by interlinking magnetism generated from the induction coil and the passive heating roller.

In a conventional structure, an extension coil spring is interposed within the passive heating roller, thereby tightly contacting the induction coil with an inside of the passive heating roller, so that the induction coil is rotated as tightly contacted with the passive heating roller by a pressure applied toward an inside of the coil spring. The insulator is interposed between the induction coil and the coil spring.

However, as a printing speed of a printer increases, a rotational speed of the fixing roller increases accordingly. When the rotational speed of the fixing roller increases, slip of the coil spring or idle rotation of the fixing roller may be caused. As a result, the induction coil may be disconnected or twisted.

Accordingly, a need exists for an image forming apparatus having an improved fixing roller having an inducting coil tightly disposed therein that is substantially prevented from slipping or idle rotation with respect to an inner surface of the roller body.

SUMMARY OF THE INVENTION

Accordingly, an aspect of the present invention is to provide a fixing roller of an image forming apparatus having an improved structure in which an induction coil is tightly contacted with an inside of a roller.

A fixing roller of an image forming apparatus includes a roller body having a pipe form. A coil assembly is mounted within the roller body and has an induction coil, the inside and outside of which are coated with insulators. A pressing pipe is mounted to the roller body to tightly bias the coil assembly toward an inner surface of the roller body. The pressing pipe has a cut portion cut away along a length direction to contract and expand in a circumferential direction.

The pressing pipe has a substantially C-shaped section in the circumferential direction.

The fixing roller further includes a key member disposed in the cut portion of the pressing pipe to prevent the pressing pipe from being contracted in the circumferential direction.

The cut portion of the pressing pipe has a mounting portion depressed from an outer circumference thereof to mount the key member, and the key member has a locking groove for engagement with an edge of the mounting portion when being received in the mounting portion.

The pressing pipe is preferably formed of a non-magnetic metal.

The pressing pipe is preferably formed of stainless steel.

The fixing roller may further include a fastening unit for fixing the pressing pipe to the roller body.

The fastening unit includes an inner cap locked in an end of the pressing pipe, and an outer cap press fitted with the end of the roller body and joined with the inner cap.

The fastening unit further includes a nut supported by an inside of the inner cap. A bolt passes through the end cap and the outer cap and couples with the nut.

The pressing pipe has a locking hole at the end thereof. The inner cap has a locking projection at an outside thereof for engagement with the locking hole.

The inner cap includes first and second inner caps respectively fit with both ends of the pressing pipe. The outer cap includes an end cap joined with the first inner cap and press fitted with an end of the roller body and a gear cap press fitted with the other end of the roller body and having a gear part on an outer circumference thereof.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWING FIGURES

The above aspect and other features of the present invention will become more apparent by describing in detail exemplary embodiments thereof with reference to the attached drawing figures, wherein.

Throughout the drawings, like reference numerals will be understood to refer to like parts, components and structures.

DETAILED DESCRIPTION OF EXEMPLARY EMBODIMENTS

Hereinafter, exemplary embodiments of the present invention are described in detail with reference to the accompanying drawing figures.

The matters defined in the description, such as a detailed construction and elements thereof, are provided to assist in a comprehensive understanding of the present invention. Thus, it is apparent that the present invention may be carried out without those defined matters. Also, well-known functions or constructions are not described in detail to provide a clear and concise detailed description.

Figure 1:
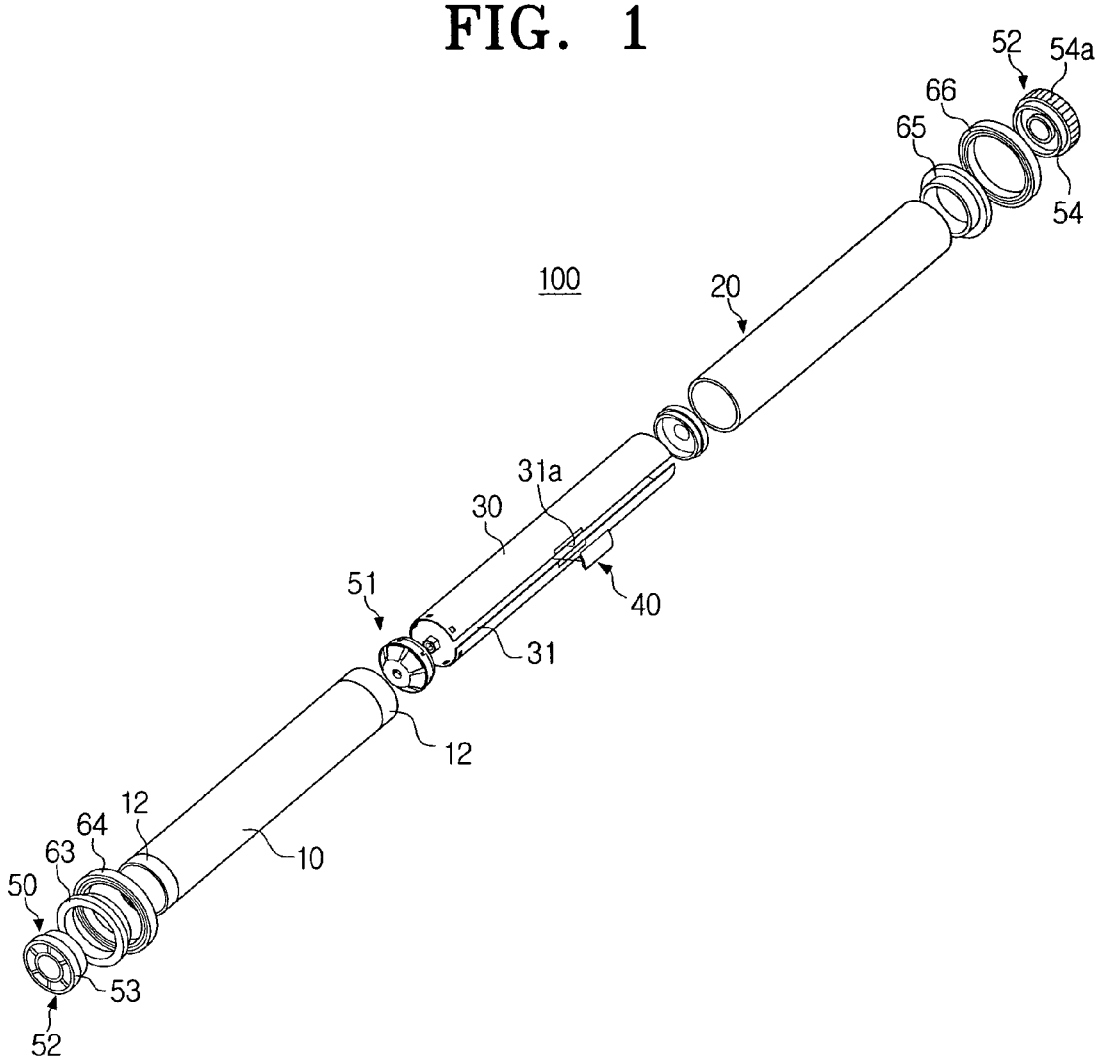
FIG. 1 is an exploded perspective view schematically showing a fixing roller of an image forming apparatus according to an exemplary embodiment of the present invention.

Referring to FIG. 1, a fixing roller 100 of an image forming apparatus, according to an exemplary embodiment of the present invention, includes a roller body 10, a coil assembly 20 mounted within the roller body 10, and a pressing pipe 30 tightly biasing the coil assembly 20 toward an inside of the roller body 10.

The roller body 10 is formed as a hollow pipe in a lengthwise direction. The roller body 10 rotates to apply predetermined heat and pressure to a printing medium, such as paper. The roller body 10 is preferably made of steel, aluminum, or copper, that is, a magnetic substance having high thermal conductivity.

Figure 2:
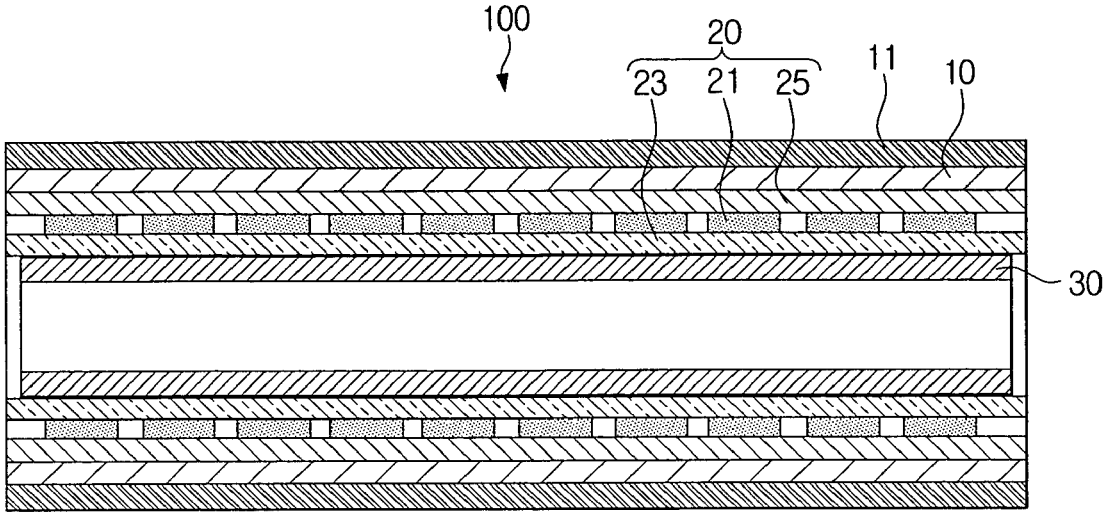
FIG. 2 is a longitudinal elevational view in cross section of the fixing roller of FIG. 1.

Both ends of the roller body 10 are open. A coating layer 11, preferably formed of synthetic resin, encloses an outer circumferential surface of the roller body 10, as shown in FIG. 2. To substantially prevent the toner image transferred on the printing medium from attaching to the roller body 10, the coating layer 11 is preferably made of a fluoric resin substance having superior thermal resistance, such as Teflon, Per Fluoro Alkoxy (PFA), or Poly Tetra Fluoro Ethylene (PTFE). A connection portion 12 is formed along an outer circumference of the both ends of the roller body 10, respectively. Bushing members 63 and 65 are press fitted with each connection portion 12. The connection portion 12 preferably has a smaller outer diameter than the other portion of the roller body 10.

The coil assembly 20 includes a driving coil 21, an inner insulator 23 and an outer insulator 25 formed at an inner side and an outer side of the driving coil 21, respectively, as shown in FIG. 2. The outer insulator 25 is layered with a predetermined thickness on an inner circumferential surface of the roller body 10. The driving coil 21 and the inner insulator 23 are then layered sequentially.

The inner and the outer insulators 23 and 25 may be preformed as a coil assembly 20 by coating the inner and the outer insulators 23 and 25 together with the driving coil 21 disposed therebetween. The coil assembly 20 may then be inserted in the roller body 10 in contact with the inner surface of the roller body 10.

The driving coil 21 may have a circular or a non-circular cross section, such as a square. Upon being supplied with power from an external source, the driving coil 21 generates a magnetic field around the roller body 10. Thus, an induced current is generated along the magnetic field by a counter electromotive force. According to the induced current, joule's heat is generated.

The driving coil 21 generates a resistant heat according to a resistant load thereof, thereby heating the roller body 10. For simultaneous generation of the inductive heat and resistant heat, the driving coil 21 is preferably formed of copper alloy, aluminum alloy, steel alloy, nickel alloy, or chrome. The driving coil 21 preferably has a predetermined thickness to have a resistance equal to or less than approximately 100Ω (ohms).

The inner insulator 23 is formed with a predetermined thickness for insulation between the driving coil 21 and the pressing pipe 30. The inner insulator 23 may be formed of a ceramic substance, such as enamel, glass and Al203, and an insulating material, such as silicon rubber, mica thin sheet, polyimide, and polyurethane.

The outer insulator 25 electrically isolates the driving coil 21 from the roller body 10. The outer insulator 25 may be formed of an insulating material, such as silicon rubber, mica thin sheet, polyimide, and polyurethane.

The inner and the outer insulators 23 and 25 may be preformed as a single assembly 20 together with the driving coil 21, and then inserted in the roller body 10. Alternatively, the outer insulator 25, the driving coil 21, and the inner insulator 23 may be sequentially layered from the inner surface of the roller body 10.

Figure 3:
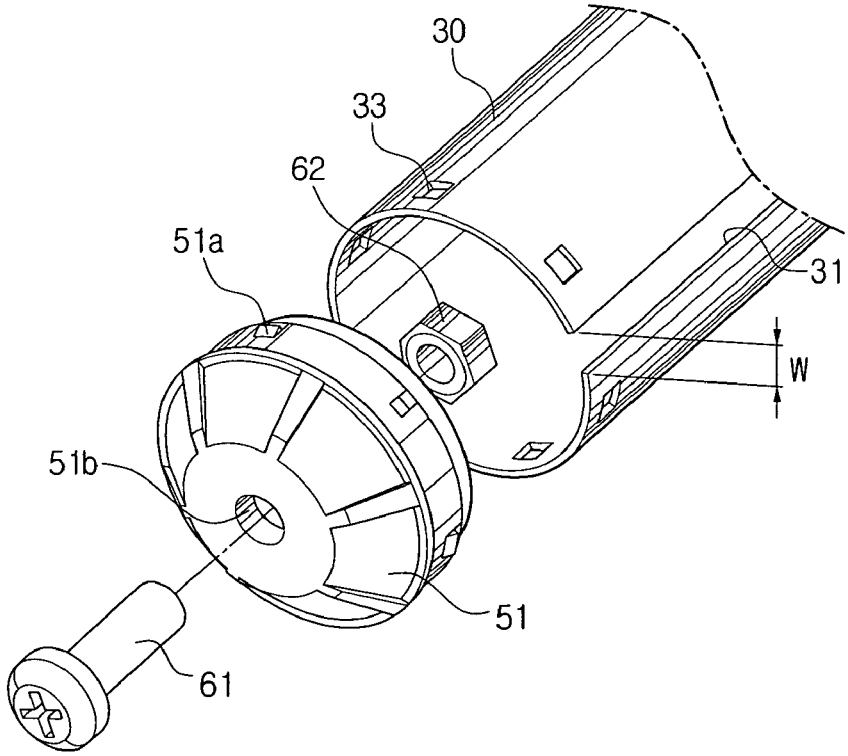
FIG. 3 is an exploded perspective view of an end of the fixing roller of FIG. 1.

The pressing pipe 30 has a smaller diameter than the roller body 10 and is press fitted in the inner insulator 23. As shown in FIG. 3, the pressing pipe 30 has a cut portion 31 cut away along a lengthwise direction of the pressing pipe 30. The cut portion 31 has a predetermined width W in a circumferential direction of the pressing pipe 30. The pressing pipe 30 may be contracted or expanded in a direction of the cut portion 31. The pressing pipe 30 has a substantially C-shaped cross section.

The pressing pipe 30 is preferably formed of a non-magnetic substance, such as stainless steel. When being fit into the inner insulator 23, the pressing pipe 30 biases the coil assembly 20 toward the inner surface of the roller body 10, so that the coil assembly 20 may be rotated together with the roller body 10 without slip or idle rotation. To apply substantially constant pressure to the coil assembly 20 with the pressing pipe 30, the width W of the cut portion 31 needs to be substantially prevented from being reduced. Therefore, a key member 40 is removably mounted in the cut portion 31 to prevent contraction of the width W of the cut portion 31, as shown in FIGS. 1 and 4.

The cut portion 31 has a mounting portion 31*a* for mounting of the key member 40. The mounting portion 31*a* is preferably formed by performing a bending process at a substantially middle portion of the pressing pipe 30 with respect to a lengthwise direction, so that the key member 40 may substantially prevent contraction of the cut portion 31 as evenly as possible throughout the whole length of the pressing pipe 30.

Figure 4:
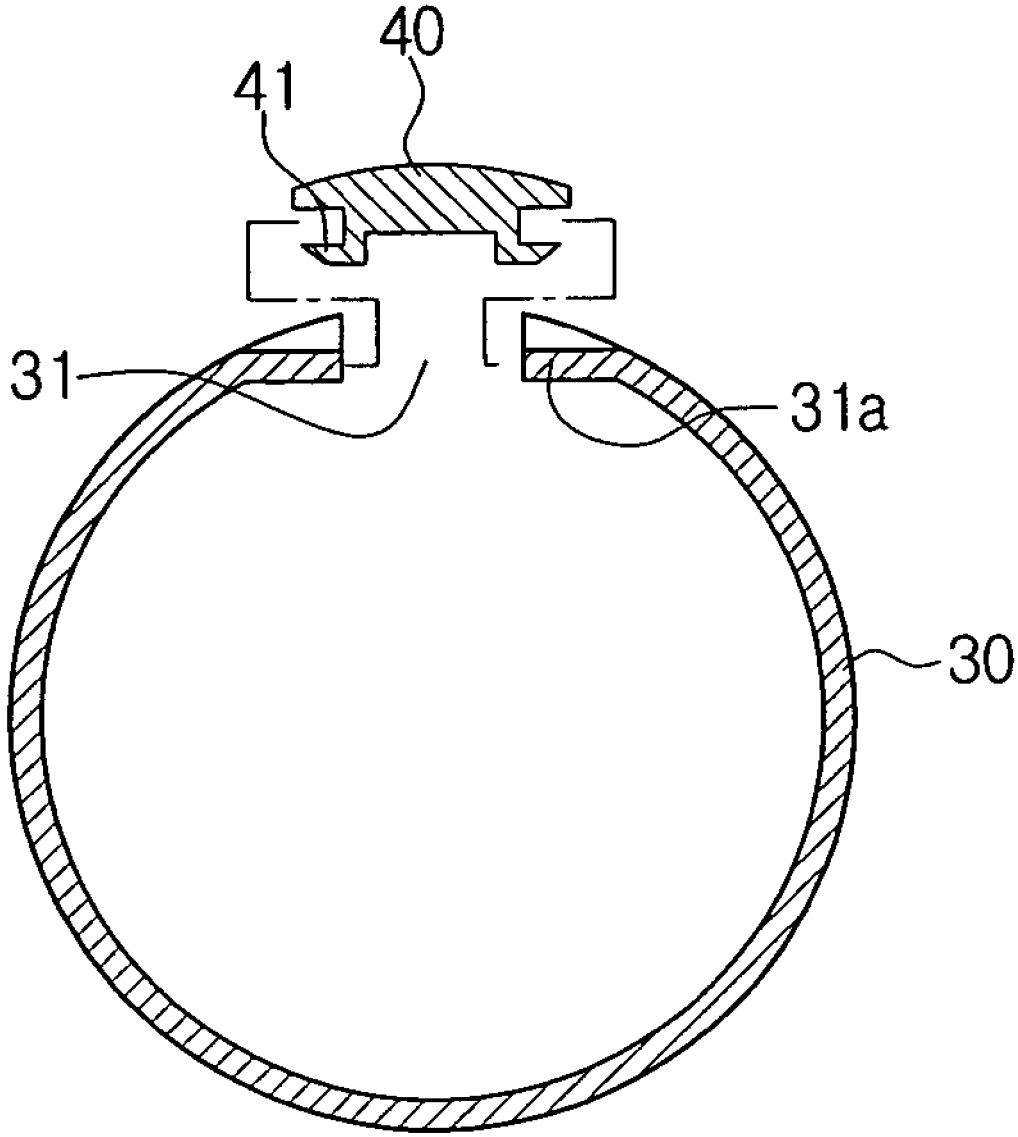
FIG. 4 is an elevational view in cross section of a pressing pipe of FIG. 1.

Referring to FIG. 4, the mounting portion 31*a* is formed as a depression by bending inwardly an outer circumference of the pressing pipe 30 by a predetermined depth.

The key member 40 has a corresponding shape to the mounting portion 31*a* and has a curved outer surface, as shown in FIGS. 1 and 4. Preferably, the curvature of the outer surface of the key member 40 is substantially similar to that of the outer surface of the pressing pipe 30. The key member 40 is seated in the mounting portion 31*a* and therefore, the outer surfaces of the key member 40 and the pressing pipe 30 are coplanarly connected (that is, the outer surfaces of the key member 40 and the pressing pipe 30 are flush), thereby improving an adherence coefficient with respect to the coil assembly 20.

The key member 40 has a locking groove 41 for engagement with an edge of the cut portion 31, more specifically with the mounting portion 31*a*. By resilient one-touch fitting between the locking groove 41 and the mounting portion 31*a*, the key member 40 may be securely fixed to the mounting portion 31*a*.

A plurality of locking holes 33 are formed at both ends of the pressing pipe 30, as shown in FIG. 3. Preferably, the plurality of locking holes 33 are formed at regular intervals along the outer circumference of the pressing pipe 30. The locking holes 33 receive an inner cap 51, which is described hereinafter.

A fastening unit 50 is further provided to fix the above-structured pressing pipe 30 with respect to the roller body 10. The fastening unit 50 includes a pair of the inner caps 51 and an outer cap 52.

Figure 5A:
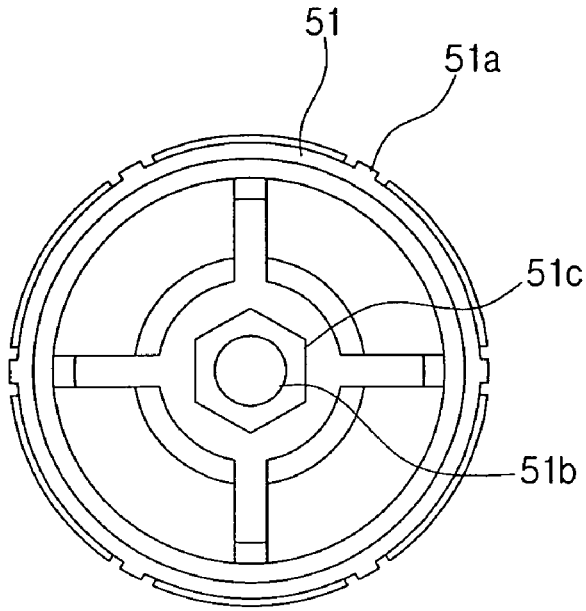
FIGS. 5A and 5B are a bottom plan view and an elevational view in cross section, respectively, of an inner cap of FIG. 1.
Figure 5B:
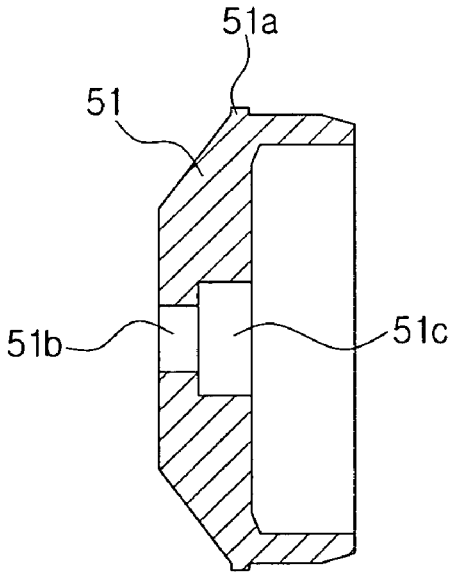

Each of the pair of inner caps 51 is press fitted to both ends of the pressing pipe 30, respectively, as shown in FIG. 1. A locking projection 51*a* is formed on an outer circumference of the inner cap 51 to be engaged with the locking hole 33, as shown in FIG. 3. A fastening hole 51*b* is penetratingly formed at the center of the inner cap 51. As shown in FIGS. 5A and 5B, a nut mounting recess 51*c* having a non-circular shape as expanded from the fastening hole 51*b* is formed on the inner surface of the inner cap 51. A nut 62 having a non-circular outer shape is inserted and fixed in the nut mounting recess 51*c*.

The outer cap 52 fixes the respective inner caps 51 to the roller body 10 and includes an end cap 53 and a gear cap 54.

Figure 6:
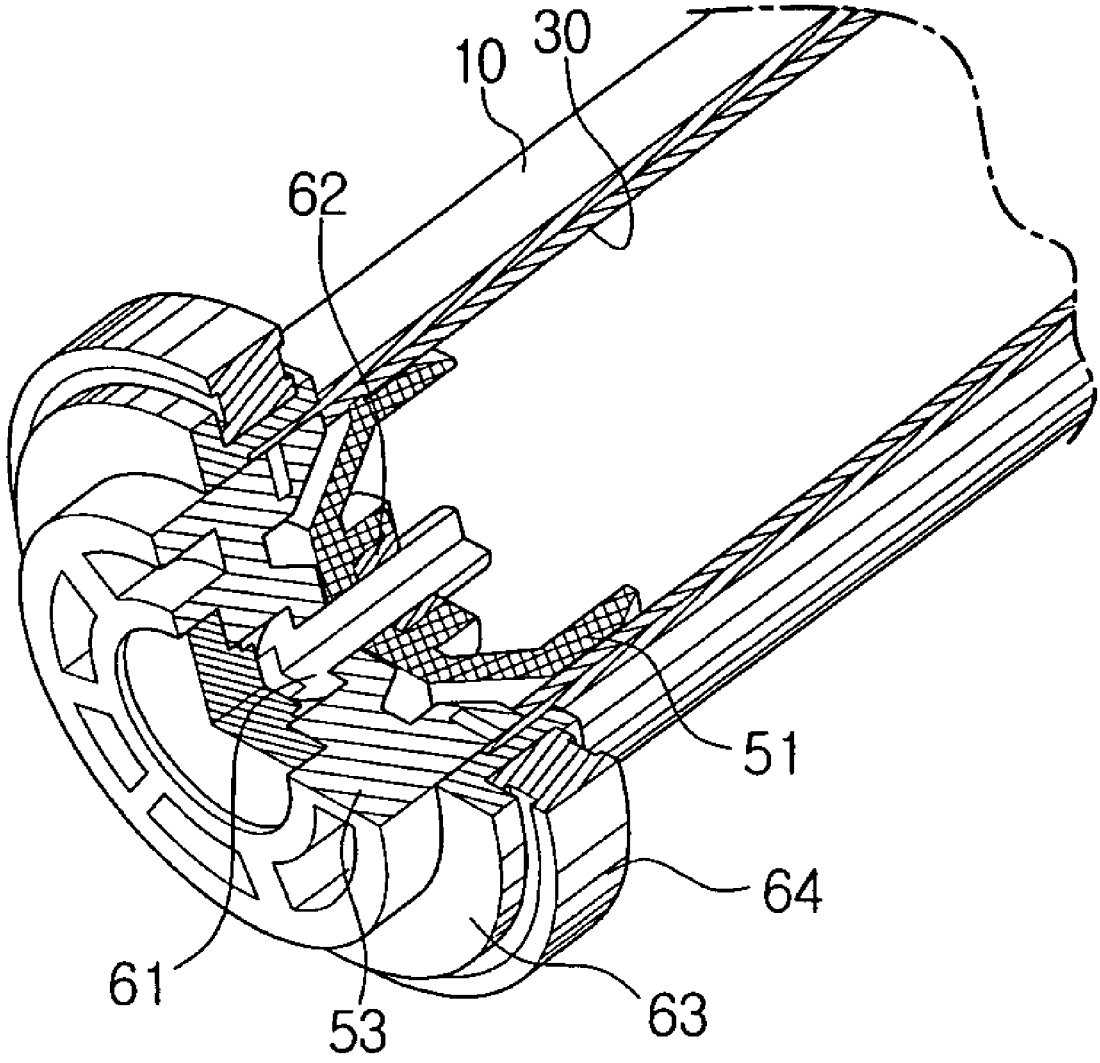
FIG. 6 is a perspective view in partial cross section of the assembled fixing roller of FIG. 1.

As shown in FIG. 6, the end cap 53 is formed to the inner cap 51 by a bolt 61 and the nut 62. The end cap 53 is fit with the inside of the end of the roller body 10. The end cap 53 is preferably formed by injection molding of a resin, such as polyphenylene sulfide (PPS), poly butilene terephthalate (PBT), and nylon, stuffed with glass fibers having high thermal resistance. A spring key (not shown) may be disposed between the end cap 53 and the roller body 10 to substantially prevent separation between the end cap 53 and the roller body 10. A bushing member 63 and a bearing 64 are fit with an outside of the end cap 53. As described above, by joining the end cap 53 and the inner cap 51 to each other through the bolt 61 and the nut 62 and press fitting the end cap 53 to the roller body 10, the pressing pipe 30 may be rotated together with the roller body 10 without slip or idle rotation of the coil assembly 20, which is biased by the pressing pipe 30.

The gear cap 54 is mounted at the opposite end of the roller body 10 corresponding to the end cap 53. In a substantially similar manner as the end cap 53, the gear cap 54 is fastened to the inner cap 51 through a bolt 61 and a nut 62 and press fitted with the inside of the roller body 10.

A gear tooth 54*a* is formed along an outer circumference of the gear cap 54 for power transmission from a predetermined driving source. Like the end cap 53, the gear cap 54 is preferably formed by injection molding a resin, such as PPS, PBT, and nylon stuffed with glass fibers. The bushing member 65 and a bearing 66 are fit with the outside of the gear cap 54.

At least one of the end cap 53 and the gear cap 54 is provided with a terminal electrically connected with the driving coil 21 to supply power to the driving coil 21 from an external source. Because the structure of such a terminal is generally known, a detailed description and illustration thereof are omitted.

Hereinbelow, a method for constructing the fixing roller of an image forming apparatus is described with reference to the accompanying drawings.

The outer insulator 25 is layered on the inner circumferential surface of the roller body 10. The driving coil 21 is spirally and evenly wound along the inner circumferential surface of the outer insulator 25.

The inner insulator 23 is then layered on an inside of the driving coil 21.

The pressing pipe 30, with the key member 40 connected thereto, is press fitted into the inner insulator 23 to tightly contact with the inside of the inner insulator 23. Because the pressing pipe 30 is restrained from being contracted in a radial direction thereof by the key member 40, the pressing pipe 30 maintains tight contact with the inner surface of the inner insulator 23. Accordingly, the pressing pipe 30 tightly biases the coil assembly 20 constructed as described above toward the inner surface of the roller body 10.

Next, the inner cap 51 and the end cap 53 are joined to each other through the bolt 61 and the nut 62 of the inner cap 51. The inner cap 51 as joined with the end cap 53 is connected to the inside of the pressing pipe 30. At the same time, the end cap 53 is press fitted with the end of the roller body 10. Before fitting the end cap 53, the bushing member 63 and the bearing 64 may be disposed between the end of the roller body 10 and the outer circumference of the end cap 53.

The gear cap 54 is joined with the inner cap 51 in the same manner as the end cap 53 and then connected to the roller body 10.

In the fixing roller 100 as structured above, the coil assembly 20 may be tightly contacted with the inner surface of the roller body 10 by the pressing pipe 30 and accordingly, slip or idle rotation of the coil assembly 20 with respect to the roller body 10 may be substantially prevented during rotation of the roller body 10. Because an expanded state of the pressing pipe 30 is constantly maintained by the key member 40, expanding pressure of the pressing pipe 30 with respect to the coil assembly 20 is also substantially constant. Furthermore, the adherence coefficient is enhanced through tightly contacting the whole outer surface of the pressing pipe 30 with the inner surface of the inner insulator 23. Therefore, the pressure applied to the coil assembly 20 may be increased compared to when using a coil spring, thereby substantially preventing idle rotation of the coil assembly 20 with respect to the roller body 10.

Moreover, firm connection between the pressing pipe 30 and the roller body 10 through the inner cap 51 and the outer cap 52 enables the pressing pipe 30 to rotate together with the roller body 10 and the coil assembly 20 when the roller body 10 is rotated. As a result, damage or breakage of the driving coil 21 may be reduced.

According to the above description, the coil assembly 20 including the driving coil 21. may be in tight contact with the inner surface of the roller body 10, through the pressing pipe 30 having a cut portion 31. The adherence coefficient may be maximized by configuring the pressing pipe 30 to have a substantially C-shaped cross section, thereby restraining loss of magnetic flux by the driving coil 21 and improving the efficiency of generating inductive heat.

Also, since the pressing pipe 30 and the roller body 10 are rotated together with the coil assembly 20, disconnection and twisting of the driving coil 21 that had been caused by slip or idle rotation of the pressing pipe 30 and the driving coil 21 may be substantially prevented, thereby improving durability and reliability.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A fixing roller of an image forming apparatus, comprising:

a roller body having a pipe form;

a coil assembly mounted within the roller body and having an induction coil, an inside and outside thereof being coated with inner and outer insulators;

a pressing pipe mounted to the roller body to tightly bias the coil assembly toward an inner surface of the roller body;

a cut away portion along a lengthwise direction of the pressing pipe to contract and expand in a circumferential direction; and a key member disposed in the cut away portion of the pressing pipe to substantially prevent the pressing pipe from being contracted in the circumferential direction.

2. The fixing roller of claim 1, wherein the pressing pipe has a substantially C-shaped cross section in the circumferential direction.

3. The fixing roller of claim 1, wherein the cut away portion of the pressing pipe has a mounting portion depressed from an outer circumference thereof to receive the key member.

4. The fixing roller of claim 3, wherein the key member has a locking groove that engages an edge of the mounting portion when being received in the mounting portion.

5. The fixing roller of claim 1, wherein the pressing pipe is formed of a non-magnetic metal.

6. The fixing roller of claim 5, wherein the pressing pipe is formed of stainless steel.

7. The fixing roller of claim 1, wherein a fastening unit fixes the pressing pipe to the roller body.

8. The fixing roller of claim 7, wherein the fastening unit includes an inner cap locked in an end of the pressing pipe; and an outer cap press fitted with the end of the roller body and secured to the inner cap.

9. The fixing roller of claim 8, wherein the fastening unit includes a nut supported by an inside of the inner cap; and a bolt passed through the inner cap and the outer cap and coupled with the nut.

10. The fixing roller of claim 8, wherein the pressing pipe has a locking hole at the end thereof, and the inner cap has a locking projection at an outside thereof for engagement with the locking hole.

11. The fixing roller of claim 8, wherein the inner cap includes first and second inner caps respectively fit with both ends of the pressing pipe.

12. The fixing roller of claim 11, wherein the outer cap includes an end cap joined with the first inner cap and press fitted with an end of the roller body and a gear cap press fitted with the other end of the roller body and having a gear part on an outer circumference thereof.

13. The fixing roller of claim 12, wherein first and second areas proximal each end of the roller body have a smaller outer diameter than a third area between the first and second areas.

14. The fixing roller of claim 1, wherein an outer surface of the key member is flush with an outer surface of the pressing pipe.

15. The fixing roller of claim 1, wherein the inner insulator of the coil assembly is made of a ceramic substance and an insulating material.

16. The fixing roller of claim 15, wherein the ceramic substance is selected from a group consisting of enamel, glass and A1203.

17. The fixing roller of claim 15, wherein the insulating material is selected from a group consisting of silicon rubber, mica thin sheet, polyimide, and polyurethane.

18. The fixing roller of claim 1, wherein the outer insulator of the coil assembly is made of an insulating material selected from a group consisting of silicon rubber, mica thin sheet, polyimide, and polyurethane.

19. The fixing roller of claim 1, wherein the induction coil has a thickness such that a resistance of the induction coil is equal to or less than approximately 100 ohms.

* * * * *